US009021767B1

(12) United States Patent
Barrett, Jr. et al.

(10) Patent No.: US 9,021,767 B1
(45) Date of Patent: May 5, 2015

(54) APPARATUS AND KIT FOR STONE VENEER PANEL INSTALLATION

(71) Applicant: Ply Gem Industries, Inc., Cary, NC (US)

(72) Inventors: David Barrett, Jr., Selinsgrove, PA (US); John M. Wade, Pleasant Hill, MO (US); Derek Zimmerman, Mifflinburg, PA (US); Alan F. Hoying, Sidney, OH (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 14/133,205

(22) Filed: Dec. 18, 2013

(51) Int. Cl.
*E04B 1/00* (2006.01)
*E04B 2/74* (2006.01)

(52) U.S. Cl.
CPC ..... *E04B 2/7457* (2013.01)

(58) Field of Classification Search
CPC ..... E04B 2/7457; E04B 9/26; E04B 9/363; E04B 9/064; E04B 9/065; E04F 15/02; E04F 15/04; E04F 2201/0115; E04F 2201/0153; E04F 2201/023
USPC ..... 52/483.1, 489.1, 506.04, 506.05, 52/506.08, 746.12, 747.1, 747.12; 248/174, 300, 903
See application file for complete search history.

(56) References Cited

U.S. PATENT DOCUMENTS

| | | | | |
|---|---|---|---|---|
| 4,163,350 | A * | 8/1979 | Doguchi et al. | 52/483.1 |
| 8,407,895 | B2 * | 4/2013 | Hartelius et al. | 29/890.033 |
| 8,424,255 | B2 * | 4/2013 | Lenox et al. | 52/173.3 |
| 8,667,744 | B2 * | 3/2014 | Shaw | 52/97 |
| 2004/0010998 | A1 * | 1/2004 | Turco | 52/762 |
| 2009/0241451 | A1 * | 10/2009 | Griffiths | 52/309.4 |
| 2013/0125492 | A1 * | 5/2013 | Molek et al. | 52/489.1 |

* cited by examiner

*Primary Examiner* — Gwendolyn W Baxter
(74) *Attorney, Agent, or Firm* — Lathrop & Gage LLP

(57) ABSTRACT

A kit for securing stone veneer panels to a structure, the kit comprising a plurality of stone veneer panels with upper and lower flanges, a plurality of brackets for securing the panels to the structure and a filler panel for placement between adjacent vertically disposed stone veneer panels to fill the gap between the panels. The brackets are secured to the structure through a bracket center mount and also utilize upper and lower wing walls to form a channel for receipt of the flange of the panels.

10 Claims, 6 Drawing Sheets

APPARATUS AND KIT FOR STONE VENEER PANEL INSTALLATION

BACKGROUND OF THE INVENTION

Field of the Invention

This invention relates in general to the construction of stone veneer panels on building structures. More specifically, the invention relates to the utilization of a kit for constructing a stone veneer panel comprising brackets, veneer panels and filler panels to fill the gap between installed panels. The panel kit effectively expedites the construction of the veneer panels, reduces costs and produces a high quality, realistic-looking, structurally sound wall.

Stone walls are expensive to construct from both a material and labor perspective. Stone veneer panels expedite the construction process by allowing the installer to utilize stone veneer panels with a large surface area to quickly cover large, structural areas once a framework using specially designed brackets are installed.

Present methods of stone wall construction typically utilize skilled masons whose services are expensive and can therefore add substantially increased cost to the final product. Moreover, the presently described apparatus and kit will require less time than the utilization of skilled masons to produce a high quality wall and generally will require less time than the present method but will not result in any lesser of a visually pleasing final product.

Accordingly, there exists a need for a stone veneer panel installation kit that may be quickly installed with minimal masonry skills on the part of the installer and yet produce a veneer wall that is seamless and realistic-looking in comparison to an authentic stone wall.

BRIEF DESCRIPTION OF THE INVENTION

In view of the foregoing disadvantages inherent in the prior art, the general purpose of the present stone veneer installation kit is to provide the user with the equipment and the methodology for quickly and efficiently installing a realistic stone veneer panel using brackets that are specially configured to interface with the veneer panels.

An object of the disclosed technology is to provide a kit that includes a plurality of brackets, veneer panels and filler panels. The brackets are secured to a building structure with screws through a center mount in the bracket. The brackets include two channels, formed by wing walls extending outwardly from the upper and lower sides for receiving longitudinally running flanges disposed on the upper and lower edges of the veneer panels. Once the veneer panel flanges are inserted into the channels, a gap exists between vertically disposed panel sections. The gap is closed with a filler panel that is set into position and adhesively secured to the wing walls of the bracket. Horizontally adjacent panel sections abut one another to form a seamlessly integrated wall that provides a realistic stone look.

Another object of the invention is to provide a stone veneer panel kit that extends the paneling away from the structure to allow movement of air and facilitate drainage of water. The brackets are specifically configured to position the panels away from the structure, providing a pathway for air to circulate and allowing passage of water down the surface of the wall unimpeded by the rear surface of the stone veneer panels. With increasing litigation over exposure to toxic mold in residential settings significant effort has been brought to bear on the elimination of construction methodologies that capture and pool moisture that ultimately leads to mold growth. Spacing between structural and ornamental layers in residential and commercial settings, sufficient for movement of air that aids in evaporation of water, will substantially reduce the prospect of mold formation.

Another object of the disclosed technology is to provide a bracket that is lightweight yet sufficiently rigid to support a stone veneer wall using opposed channels to support the flanges of stone veneer panels.

These, together with other aspects of the disclosed technology, along with the various features of novelty that characterize the technology, are pointed out with particularity in the claims annexed hereto and form a part of this disclosed technology. For a better understanding of the disclosed technology, its operating advantages and the specific objects attained by its uses, reference should be made to the accompanying drawings and descriptive matter in which there are illustrated exemplary embodiments of the disclosed technology.

BRIEF DESCRIPTION OF THE SEVERAL VIEWS OF THE DRAWINGS

Illustrative embodiments of the disclosed technology are described in detail below with reference to the attached drawing figures, which are incorporated by reference herein and wherein.

DETAILED DESCRIPTION

Embodiments of the disclosed technology can be included within a kit for constructing a stone veneer panel wall. To provide context for the disclosed technology, consider FIGS. 1-10, which show the preferred embodiment of the panels and bracket.

Figure 1:
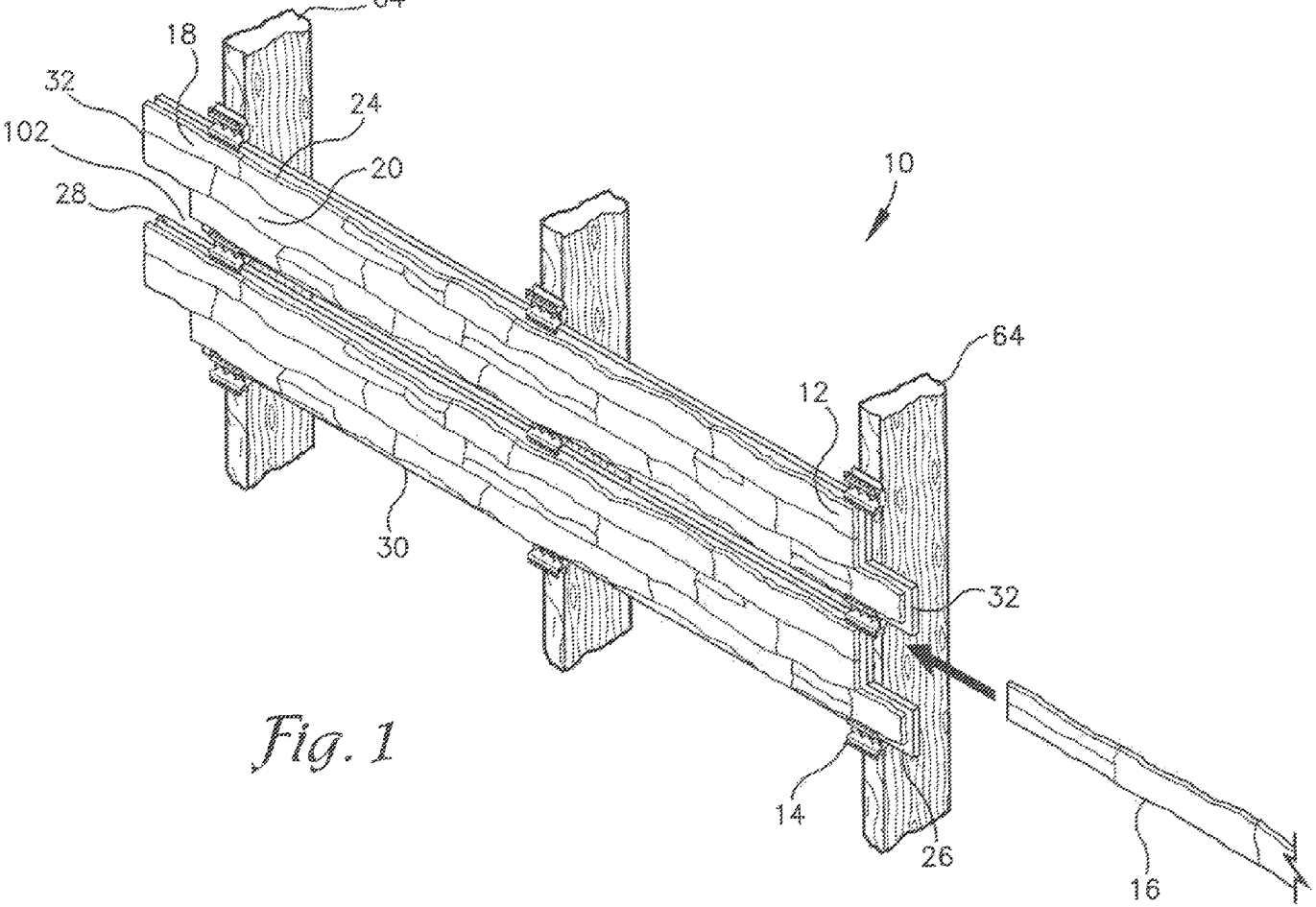
FIG. 1 is a perspective view of a portion of an embodiment of a stone veneer wall with stone panels, brackets and filler panels shown in preparation for insertion between the stone panels.
Figure 10:
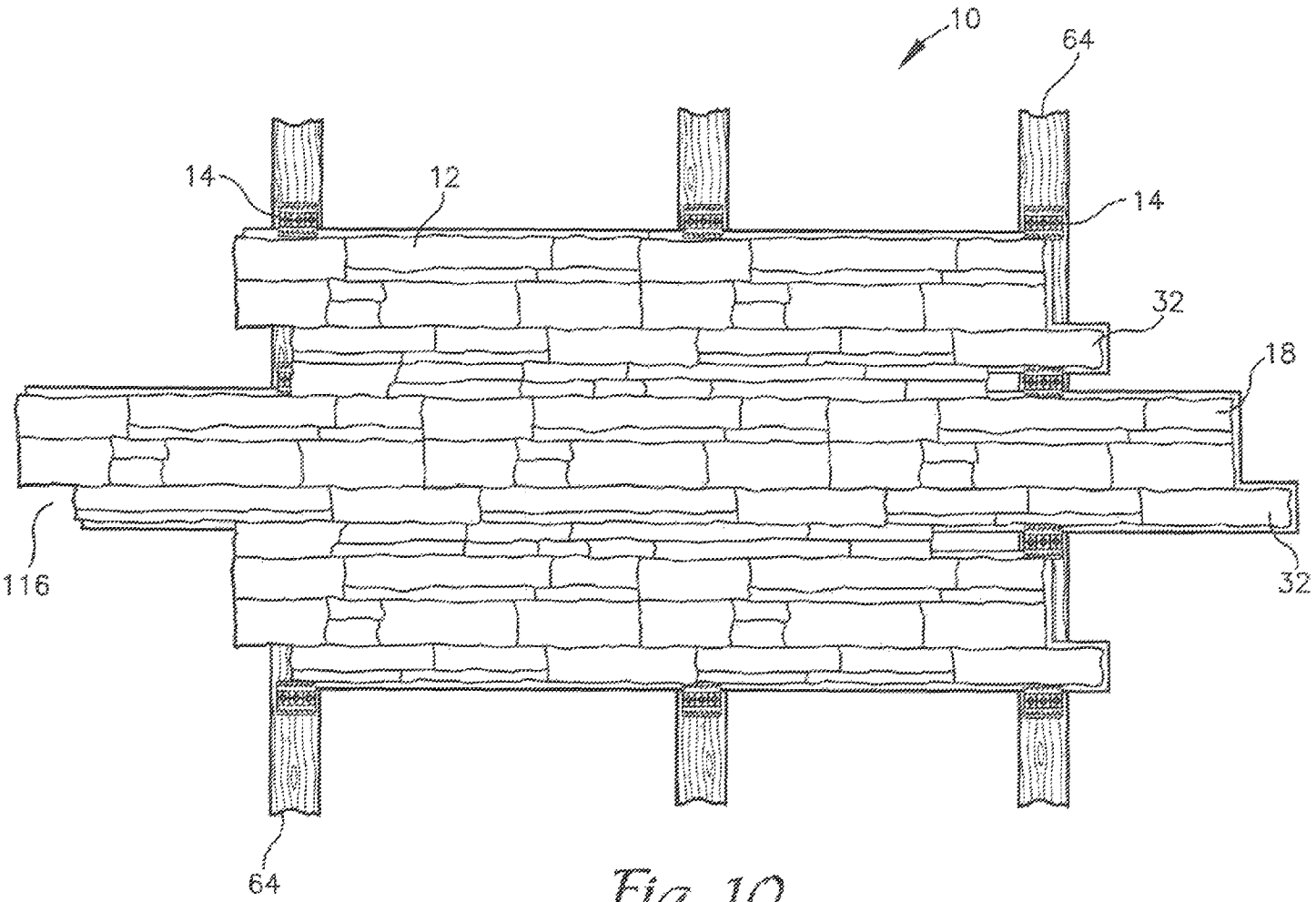
FIG. 10 is a perspective view of an embodiment of a stone veneer wall with the brackets, panels and filler panels in fully assembled position.

The stone veneer panel kit 10 is shown partially assembled at FIG. 1 and fully assembled at FIG. 10 is configured for attachment to a rigid vertical structure such as an exterior or interior wall of a building. The panel kit 10 is comprised of stone panels 12, brackets 14 and filler panels 16 which are all used in combination to produce a stone wall that is seamlessly integrated with an appearance that is remarkably similar to a wall finished by a professional stone mason using stone blocks.

The concrete stone panels 12 and filler panels 16 are fabricated from a composite mixture of Type 1 Portland cement and lightweight aggregate. The lightweight aggregate includes rotary kiln expanded slate lightweight aggregate, such as that produced by the Stalite Company. The lightweight concrete produced from the mixture of the Type 1 Portland cement and the lightweight aggregate preferably weighs less than 95 pounds per cubic foot.

Figure 2:
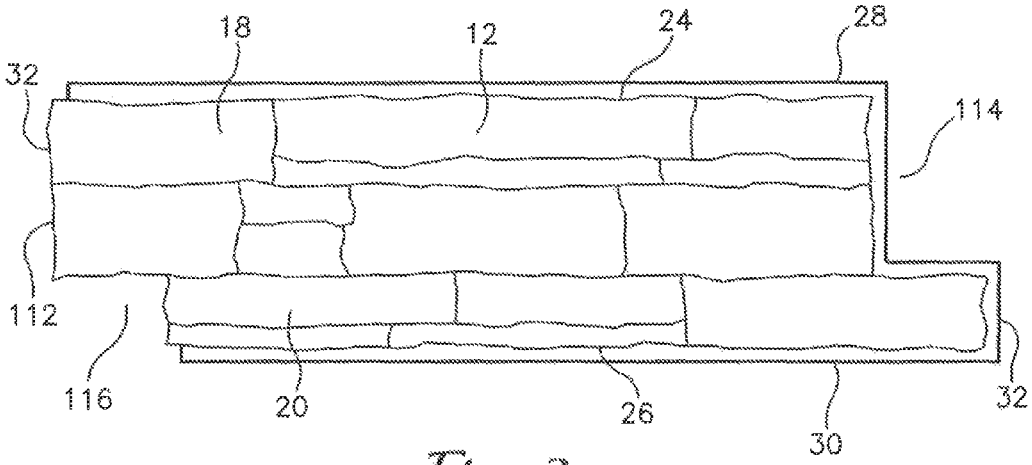
FIG. 2 is a front elevation view of an embodiment of a stone panel.

As seen in FIG. 2, the stone panels 12 include a textured front surface 18 that simulates the look and feel of natural stone. The textured front surface 18 includes stones 20 in a variety of heights and widths and can be produced in a single color or with stones in multiple colors. The panel 12 is produced from concrete and formed in a rubberized mold which facilitates extraction of the stone panel 12 upon curing of the concrete.

Figure 7:
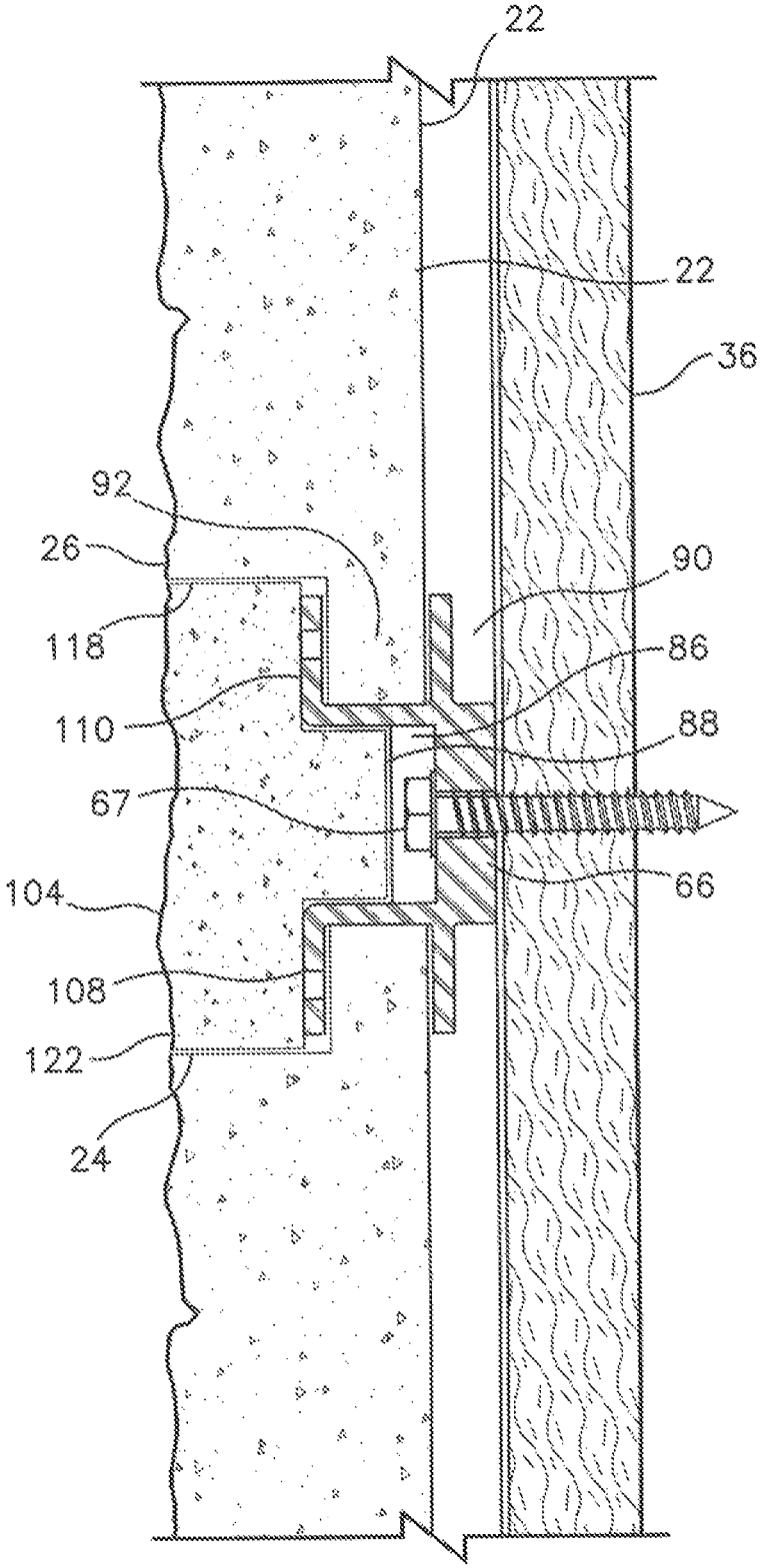
FIG. 7 is a sectional view of an embodiment of a bracket secured to the building structure with a screw and showing embodiments of two stone panels in position between the upper and lower wing walls and an embodiment of a filler panel disposed between the upper and lower stone panels.

As is best seen in FIG. 7, the stone panel 12 further includes a rear surface 22 that is substantially flat. The thickness of the stone panel 12 is generally less than 3 inches and preferably in the range of 1.5 to 2 inches overall. Different heights and widths of the stone panel may be made available depending upon the texture and coloration of the front surface 18 of the panels. Referring again to FIG. 2, the panel 12 also includes an upper edge 24 and a lower edge 26 that are textured consistent with the stone paneling but are substantially level. As seen in FIGS. 1 and 2, extending outwardly from the stone panel at the upper and lower edges 24, 26 are flanges 28, 30 that are for receipt into the bracket 14, which will be more fully described below. The upper and lower panel flanges 28, 30 traverse nearly the entire circumference of the panel and may extend to the outer reaches of the overhang portion 32 or may terminate short of the overhang portion 32. The flanges 28, 30 are preferably from 0.25 to 0.75 inches in thickness and preferably in the range of from 0.25 inches to 0.75 inches in height but may be fabricated in a variety of widths and heights to accommodate different widths of bracket channels 34. The flanges 28, 30 must; however, be of sufficient thickness to avoid readily fracturing from impacts with the brackets during installation and inadvertent impacts with other solid objects. Likewise, the flanges 28, 30 cannot be too thick or the weight of the panels 12 will become an impediment to efficient manual installation.

As previously noted, the overhang portions 32 exist on both the upper 24 and lower 26 edges of the panel 12 but on opposite sides of the panel and serve to diminish creating an unappealing block appearance to the finished wall. Some panels in the kit will not include one of the overhangs so that the wall veneer can be properly finished. For example, in one embodiment an overhang 32 extends outwardly to the left at the top of the panel 12 but not to the right at the bottom of the panel. This panel 12 is for completing a section at the right side of the wall. In another panel embodiment there is an overhang 32 that extends outwardly from the panel 12 to the right but not at the bottom left of the panel 12. This panel would be utilized to complete a section at the left side of the wall. Various permutations of panels with overhangs on one or both sides are required to fully complete most wall sections.

In order to secure the stone veneer panels 12 to a structure 36, the kit 10 includes brackets 14 that are constructed of a sturdy material, such as steel, aluminum or engineered plastic and that are capable of supporting a stone veneer panel 12 without fracturing or bending. The brackets 14, as seen in FIGS. 3-6, are preferably configured as a box 38 with two lateral walls 40, 42 and two longitudinal walls 44, 46. Each lateral wall has an interior surface 48, 50 as well as an upper edge 56 and a lower edge 58.

Figure 3:
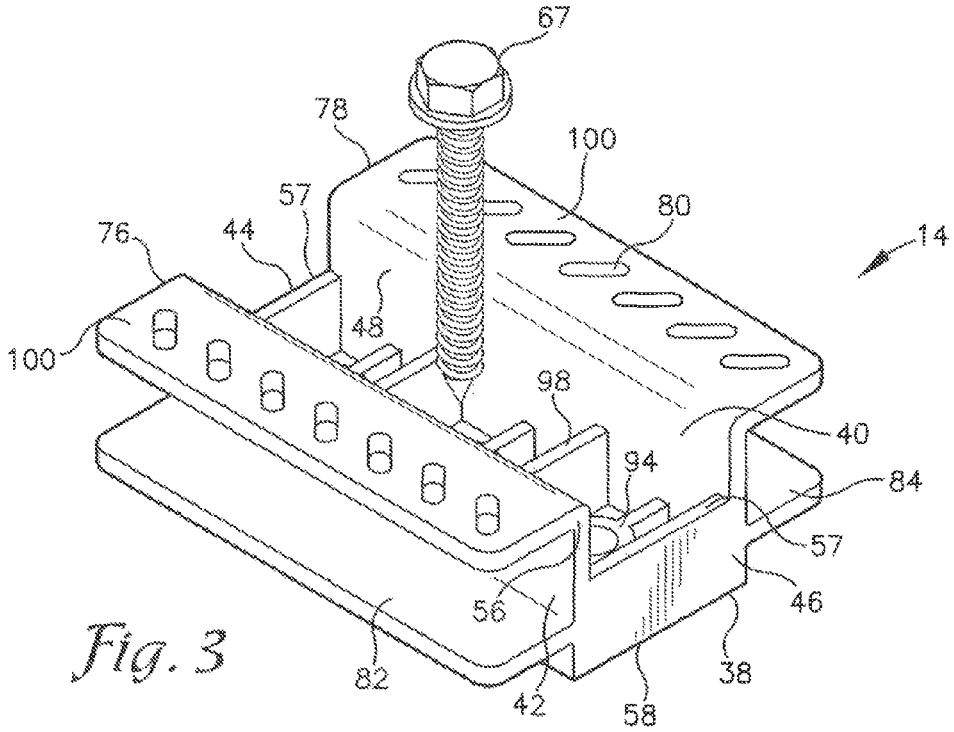
FIG. 3 is a perspective view of an embodiment of a panel bracket with a securing screw in position adjacent the bracket.
Figure 4:
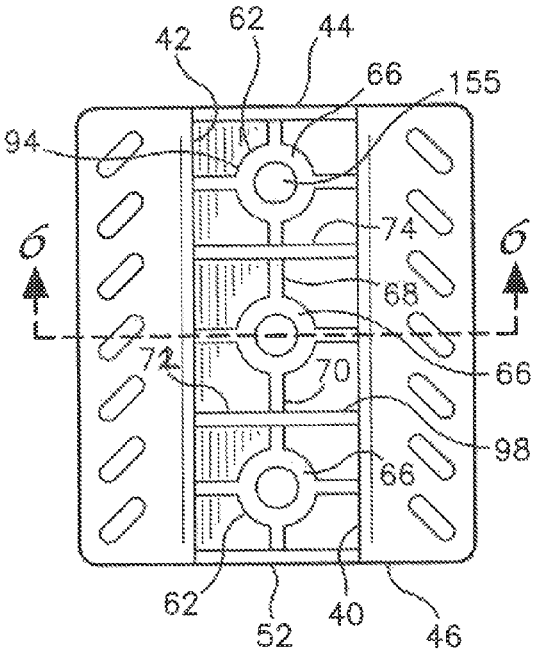
FIG. 4 is a top plan view of an embodiment of a bracket displaying the top wing walls.
Figure 5:
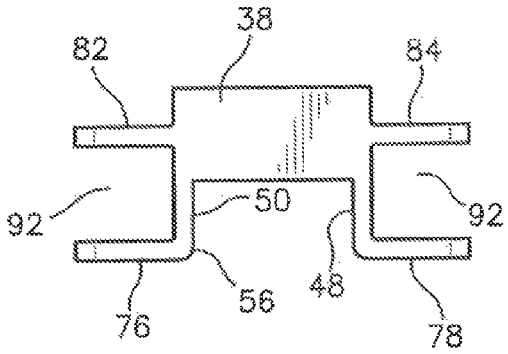
FIG. 5 is a side elevation view of an embodiment of a bracket detailing the two sets of wing walls.
Figure 6:
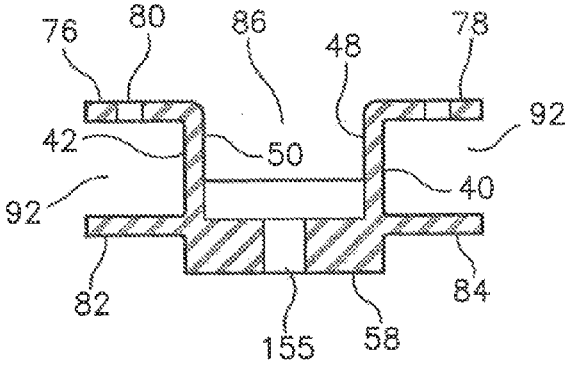
FIG. 6 is a cross sectional view of an embodiment of a bracket shown in the direction 6-6 of FIG. 4.

As best seen in FIGS. 3 and 4, the bracket box 38 employs a center mount 62 for securing the bracket to a structural feature such as a wall stud 64. The center mount 62 preferably comprises one or more adjacent circular lugs 66 through which an attachment means 67, preferably threaded, is passed to secure the bracket to a wall stud 64. As seen in FIGS. 4 and 6, the circular lugs 66 are configured with a round opening 155 to accommodate, for example, a hexagonal headed cap screw 67 that is of sufficiently robust dimensions to support the weight of a bracket 14 that is loaded with a veneer panel 12. As seen in FIG. 4, the circular lug 66 is secured to two lateral webs 68, 70 that in turn are secured to two longitudinal webs 72, 74. The longitudinal webs 72, 74 are themselves secured to the two lateral walls 40, 42. The webs 68, 70, 72, 74 are sufficiently robust in their dimensions and in their connection strength to adjoining webs and walls to support the weight of the stone veneer panels 12.

As seen in FIGS. 3-6, the bracket 14 further employs upper wing walls 76, 78 that extend outwardly from above the upper reaches 56 of the lateral walls 40, 42. As seen in FIG. 3, the upper edges 57 of the longitudinal walls 44, 46, the upper surface 94 of the circular lug 66 and the upper edges 98 of the longitudinal webs 72, 74 are recessed below the top surface 100 of the upper wing walls 76, 78. All of these surfaces are recessed below the upper wing wall surface 100 creating an inner slot 86 in the bracket 14 which is best seen in FIG. 6. As best seen in FIG. 7, the recessed inner slot 86 receives the downwardly extending rib 88 of the filler panel 16. The upper wing walls 76, 78 extend outwardly approximately 0.75 inches and preferably traverse the entire length of the lateral wall 40, 42 of the bracket box 38. However, upper wing walls 76, 78 of a lesser traverse may also satisfy the desired objective. The upper wing walls 76, 78 also may include through holes 80 that facilitate the adhesion of an industrial adhesive applied to the back of the filler panel 16 and the upper surface of the wing walls 76, 78 for purposes of permanently securing the filler panel 16 to the wing walls 76, 78.

As seen in FIGS. 3-6, situated beneath the upper wing walls 76, 78 are lower wing walls 82, 84. The lower wing walls 82, 84 run parallel to the upper wing walls 76, 78 and extend substantially perpendicularly outwardly from the bracket box lateral walls 40, 42. The lower wing walls 82, 84 are situated beneath the upper wing walls 76, 78 and separated from the upper wing walls by approximately 0.75 inches; however, separation distances can vary depending upon the size of the panel flanges 28, 30 that are to be utilized in the wall construction. As seen in FIG. 6, the lower wing walls 82, 84 do not extend outwardly from the lowest edge 58 of the bracket box 38 but extend outwardly above the lower edge 58 so that when the flanges 28, 30 of the stone panels are received into the channel 92 the rear surface 22 of the panel 12 does not contact the wall stud 64 or the wall surface. The bracket 14 design purposefully avoids contact between the rear surface 22 of the panel 12 and the wall studs 64, or wall surfaces, in order to create an air gap 90, as best seen in FIG. 7. Because the lower wing walls 82, 84 are positioned away from the lower edge 58 of the bracket 14 air can circulate behind the stone veneer panel 12 when it is installed. The gap 90 allows air to circulate which facilitates moisture removal thereby limiting the growth of mold.

As seen in FIG. 6, the separation distance between the upper wing walls 76, 78 and the lower wing walls 82, 84 forms a channel 92 for receiving either the upper panel flange 28 or the lower panel flange 30. The brackets 14 are installed so that the channels 92 are horizontal in orientation and can receive both upper and lower flanges 28, 30 in order to stabilize the panel 12 when in position against a structure 36.

The highest and lowest course of panels on a wall may use a second embodiment of the bracket 14 described above. The second embodiment of the bracket 14 includes an upper and lower wing wall 76, 82 on a single side of the bracket box 38. The lowest course of panels on a wall only requires a bracket 14 with a single upward facing channel 92 for receiving a panel that it is supporting from below. The uppermost course of panels will only need a bracket 14 with a single downward facing channel 92. This second embodiment of the brackets 14 will facilitate finishing of the wall above and below the edges of the panels.

Figure 8:
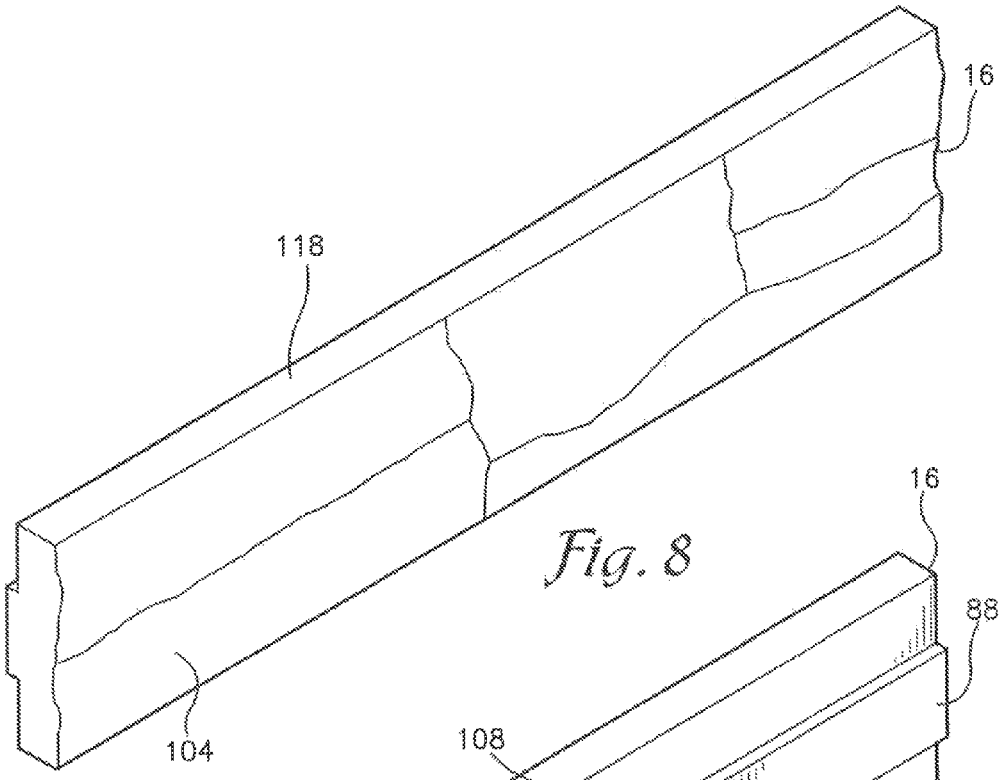
FIG. 8 is a perspective view of the front textured surface of an embodiment of a filler panel.
Figure 9:
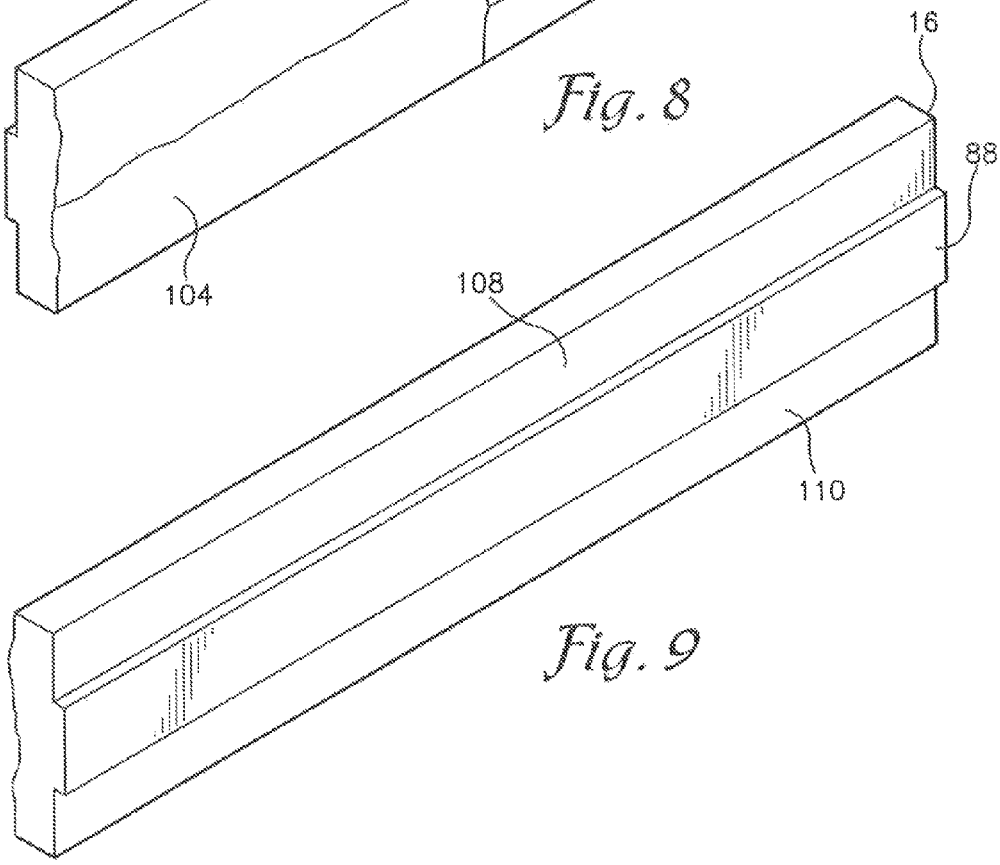
FIG. 9 is a perspective view of the rear surface of an embodiment of a filler panel with an outwardly extending center rib.

As seen in FIG. 8, the veneer panel kit 10 also includes a filler panel 16 for placement into the gap 102 between vertically adjacent panels 12. The filler panel 16 has a front surface 104 that is textured consistent with the front surface of the stone panels 12. The back surface, seen in FIG. 9, is generally smooth but includes a longitudinally running outwardly extending center rib 88. On each side of the rib 88 are flat portions 108, 110 that will contact the top surface of the upper wing walls 100 when installed in position. The center rib 88, when in position, will be received into the recessed inner slot 86 of the bracket box 38. As previously noted, to secure the filler panel 16 in position between vertically adjacent panels, a construction adhesive such as Loctite® PowerGrab® Heavy Duty Interior/Exterior Construction Adhesive, or a similar high quality adhesive, is applied to the flat portions 108, 110 which when placed in position will contact the top surface 100 of the upper wing walls 76, 78. The construction adhesive will seep into the through holes 80 of the upper wing walls and provide a three dimensional bond firmly securing the filler panel to the upper wing walls.

When constructing a veneer panel wall, the installer must first construct a sufficiently rigid structure 36 that can withstand the load to be applied when the brackets 14 and panels 12 are in position. The brackets 14 are secured to a wall stud 64 at preselected separation distances depending upon the dimensions of the panel 12. To secure a bracket 14 to a wall stud, typically a hexagonal headed cap screw 67 will be inserted through the lug 66 of the center mount 62 and into the wall stud 64. When properly oriented, the channel 92 running between the upper and lower wing walls 72, 74, 76, 78 will be horizontal in orientation. At least three, and preferably four, brackets 14 will typically be required to properly support a panel 12 in position on a structure. Preferably, a panel 12 is supported at the four corners to minimize the prospect for shearing off a supporting screw because of excessive weight and to prevent rotation of the panel out of the brackets should an installer attempt to use only a single bracket at the lower edge and two brackets at the upper edge. As previously discussed, a bracket at the lower edge of a wall, a second embodiment of the bracket design, will only require wing walls on a single side of the bracket and a bracket positioned at the top of course of paneling only utilizes a bracket with wing walls on a single side of the bracket.

Once the first brackets are secured to the wall studs 64, or other structural features, and the first panel is in place the installer secures additional brackets 14 adjacent to the first panel so that the second panel may be mounted to the wall. The first and second panels partially mate at panel side edges 112, 114 which are seen in FIG. 2. Additionally, all panels except for panels at the end of a wall section will typically have an overhang portion 32 at the top of the panel and at the bottom of the panel. These overhang portions 32 mesh with a cutout portion 116 of the adjacent panel. The overhang portions 32 and cutout portions 116 mesh together and serve to visually obscure the mating surfaces of the adjacent panels and produce a more realistic looking stone wall.

Panels that are placed at the end of a wall are configured to accept an overhang portion 32 on the interior side of the panel but are not configured with a cutout portion near the edge of the wall as there will be no adjacent panel installed that will fill the void of the cutout 116 with an overhang 32. Consequently, some panel embodiments will only include a single cutout portion 116 or a single overhang 32 depending upon where the panel 12 is to be installed in the wall.

As seen at FIG. 1, once all panel sections are received into the bracket channels 92 there remains a gap 102 between adjacent vertically disposed panels 12. This gap 102 is to be filled with the filler panels 16 to create a seamless and gapless veneer panel. As seen in FIG. 7, the filler panel rib 88 is received into the recessed inner slot 86 of the bracket box 38 and the upper edge 118 of the filler panel 16 is closely spaced from the lower edge 26 of the panel immediately above the filler panel 16. Likewise, the lower edge 122 of the filler panel 16 is closely spaced from the upper edge 24 of the panel immediately below the filler panel. Prior to placement of the filler panel 16 into the gap 102 between adjacent panels, the installer will apply a construction adhesive to the rear surface 106 of the filler panel and in particular to the flat portions 108, 110 on each side of the rib. The filler panel rib 88 is then positioned into the recessed inner slot 86. Once the rib is installed within the inner slot 86 the various edges of the filler panel 118, 122 will be closely spaced from the edges of the adjacent panels 24, 26. Because the separation between the filler panel edges 118, 122 and the panel edges 24, 26 is so small, the casual observer will be unable to perceive any gap at all and consider the panel as a highly realistic, professionally installed, authentic stone wall. The fully assembled stone veneer panel wall can be seen in FIG. 10.

Many different arrangements of the various components depicted, as well as components not shown, are possible without departing from the spirit and scope of the disclosed technology. Embodiments of the disclosed technology have been described with the intent to be illustrative rather than restrictive. Alternative embodiments will become apparent to those skilled in the art that do not depart from its scope. A skilled artisan may develop alternative means of implementing the aforementioned improvements without departing from the scope of the disclosed technology.

It will be understood that certain features and sub combinations are of utility and may be employed without reference to other features and sub combinations and are contemplated within the scope of the claims. Not all steps listed in the various figures need be carried out in the specific order described.

The invention claimed is:

1. A bracket for securing at least one panel of stone veneer to a structure, the bracket comprising:

a box with two lateral walls, two longitudinal walls and an interior space, each wall having an interior and an exterior surface, an upper edge and a lower edge;

at least two reinforcing ribs running between and secured to the two lateral walls in the interior space of the box;

a center mount disposed between and secured to the at least two reinforcing ribs, the center mount for use in connecting the bracket to the structure;

an upper wing wall extending outwardly from the upper edges of each of the two lateral walls; and a lower wing wall extending outwardly from both of the lateral walls, the lower wing walls disposed beneath the upper wing walls and above the lower edge of each of the lateral walls, the space between the upper and lower wing walls on each lateral wall forming a wing wall channel, wherein a securing apparatus is passed through the center mount to secure the bracket to the structure and a flange of at least one stone veneer panel is received into the wing wall channel to support the panel in position.

2. The bracket of claim 1, wherein a top surface of the center mount is recessed below the upper edge of the lateral and longitudinal walls.

3. The bracket of claim 1, wherein the center mount is further secured to the lateral walls by at least two rigid web members.

4. The bracket of claim 1, wherein the upper wing walls include at least one adhesive port.

5. The bracket of claim 1, wherein the center mount further comprises an opening for passage of a retaining member through the center mount and into the structure.

6. The bracket of claim 5, wherein the retaining member is a screw.

7. The bracket of claim 1, wherein the bracket is fabricated from an engineered plastic.

8. The bracket of claim 1, wherein the separation distance of the upper and lower wing walls forming the wing wall channel is in the range of from 0.5 to 1.5 inches.

9. A bracket for securing at least one panel of stone veneer to a structure, the bracket comprising:

a box with two lateral walls and two longitudinal walls an interior space and an upper and lower surfaces, each wall having an interior and exterior surfaces and upper and lower edges;

at least two reinforcing ribs running between and secured to the two lateral walls in the interior space of the box;

a center mount disposed between and secured to the at least two reinforcing ribs, the center mount for use in connecting the bracket to the structure;

at least one upper wing wall extending outwardly from the upper edge of at least one lateral wall; and at least one lower wing wall connected to one of the lateral walls and disposed beneath the at least one upper wing wall and above the lower edge of the lateral wall, the upper and lower wing walls combination forming a wing wall channel, wherein a fastening apparatus is passed through the center mount to secure the bracket to the structure and a flange of at least one stone veneer panel is received into the wing wall channel to support the panel in position.

10. The bracket of claim 9, wherein when the bracket is secured to the structure the separation distance between the lower surface of the bracket which is in contact with the structure and the at least one lower wing wall produces a gap between the building structure and the stone veneer panel which is received within the channel of the bracket, the gap facilitating the movement of air and water between the stone veneer panel and the structure.

* * * * *